United States Patent [19]

Matosian et al.

[11] Patent Number: 4,668,869

[45] Date of Patent: May 26, 1987

[54] MODULATED OPTICAL ENERGY SOURCE

[75] Inventors: Kenneth R. Matosian, Los Altos; Lanny W. Sterritt, Palo Alto; David M. Stubbs, San Jose, all of Calif.; Thomas M. Lemons, Marblehead, Mass.

[73] Assignee: The United States of America as represented by the Secretary of the Air Force, Washington, D.C.

[21] Appl. No.: 788,188

[22] Filed: Oct. 16, 1985

[51] Int. Cl.[4] ..... F41J 9/13

[52] U.S. Cl. ..... 250/504 R; 250/493.1

[58] Field of Search ..... 250/504 R, 504 H, 503.1, 250/493.1; 350/1.1, 97; 362/277, 282; 116/20

[56] References Cited

U.S. PATENT DOCUMENTS

| | | | |
|---|---|---|---|
| 1,421,506 | 7/1922 | Limpert . | |
| 1,628,862 | 5/1927 | Townsend . | |
| 2,934,633 | 4/1960 | Cumming | 240/1.2 |
| 3,219,809 | 11/1965 | Bulic | 240/7.1 |
| 3,532,433 | 10/1970 | Hopkins et al. | 356/121 |
| 3,919,542 | 11/1975 | Castic | 240/41.55 |
| 4,019,062 | 4/1977 | Rongren | 250/504 R |
| 4,241,389 | 12/1980 | Heimer | 362/297 |
| 4,343,033 | 8/1982 | Suzuki | 362/307 |

*Primary Examiner*—Bruce C. Anderson
*Assistant Examiner*—Jack I. Berman
*Attorney, Agent, or Firm*—Gerald B. Hollins; Donald J. Singer

[57] ABSTRACT

An optical radiant energy source capable of far infrared spectrum operation and on-off energy modulation without interruption of the radiation sources operating temperature characteristics. Provisions for radiant energy dissipation as part of the modulation, for achieving uniform output beam dispersion over a specified area, and for airframe mounting of the disclosed apparatus are also included.

26 Claims, 1 Drawing Figure

MODULATED OPTICAL ENERGY SOURCE

RIGHTS OF THE GOVERNMENT

The invention described herein may be manufactured and used by or for the Government of the United States for all governmental purposes without the payment of any royalty.

BACKGROUND OF THE INVENTION

This invention relates to the field of radiant or optical energy sources of the type providing output in the visible, near infrared, and far infrared spectral regions.

For testing the ability of a guidance system such as might be employed in a present-day missile weapon of the infrared responsive type, it is desirable to employ optical energy sources capable of providing controllable bursts of radiant energy of predetermined spectral content for simulated target energizing of the missile guidance system. The energy sources used for this purpose should desirably have multi-wavelength high irradiance capability and small physical size. Such characteristics enable the testing of a variety of guidance system sensors having differing spectral frequency responses and allows airborne use of the energy source for in-flight guidance system testing. For such airborne guidance system testing, a plurality of energy sources might, for example, be mounted around the periphery of a drone or piloted aircraft so as to be visible over a wide azimuth. Energy source use in airborne environments, of course, emphasizes the need for small size, minimum weight, and rugged vibration-immune construction. The airborne environment also involves the presence of a large range of environmental conditions including high humidity, high temperature ground level conditions and sub-zero low humidity, high altitude flight level conditions—conditions that are together capable of taxing the endurance of conventional energy sources.

In order that such a simulated-target energy source be capable of replicating the on-off defensive and operating characteristics of in real-life infrared signature targets, it is desirable to include therein an energy modulation capability for terminating the irradiated energy either periodically or in response to a command signal. Since the electrical energy transducer devices, such as resistance heaters or lamps, that are desirable for use as sources of infrared energy, inherently require a relatively long period of warm-up to achieve stable spectral and amplitude outputs, it is additionally desirable for a simulated target source of this type to use modulation other than interruption of electrical energy supply. Mechanical shuttering in the form of energy path blocking devices or physically relocatable mirror arrangements have been found particularly suitable for providing such modulation of simulated target energy.

Energy sources of this same general capability are also useful in signalling devices, weapon deception equipment, and in other military apparatus, both in airborne and ground environments, as well as for shipboard and nautical equipment. For such alternate uses, portions of the energy spectrum in addition to the preferred far infrared region applicable to infrared missile acquisition and tracking systems, i.e., visible spectrum and near infrared spectrum energy, may also be attractive.

The patent art includes a number of lamps, lamp housing arrangements and optical systems usable for providing visible and infrared spectrum optical energy output. Included in this art is the patent of Kiyoshi Suzuki, U.S. Pat. No. 4,343,033, which concerns a marker light for use in an airport and similar environments wherein an apparatus is to be embedded in the earth and is to comprise a part of some structure such as a runway. The Suzuki light includes a source of visible spectrum energy and a plurality of optical elements including lenses, reflectors, and environmental sealing members.

Another lamp fixture suitable for use in aircraft runways and similar environments is shown in the patent of R. W. Cumming, U.S. Pat. No. 2,934,633, which describes a ruggedized earth-mountable structure capable of providing visible spectrum emission.

Other examples of optical energy source apparatus are found in the patents of E. L. Hopkins et al, U.S. Pat. No. 3,532,433, an automotive headlamp aiming system; J. R. Townsend, U.S. Pat. No. 1,628,862, a locomotive headlamp; Richard J. Heimer, U.S. Pat. No. 4,241,389, a multiple source imaging system; A. S. Limpert, U.S. Pat. No. 1,421,506, an automotive headlamp; D. J. Bulic, U.S. Pat. No. 3,219,809, a glareless automotive headlamp; and William A. Castic, U.S. Pat. No. 3,919,542, a floodlight frame assembly.

These patent art energy sources fall short of providing a shutter-modulated source of well diffused radiant energy capable of extending into the far infrared region and capable of use in the widely varying and hostile environment of an aircraft or other military applications.

SUMMARY OF THE INVENTION

An object of the present invention is to provide a modulatable source of far infrared spectrum radiant energy.

Another object of the invention is to provide a ruggedized, environmentally-isolated source of radiant energy capable of being mounted in a plurality of different host equipment.

Another object of the invention is to provide a radiant energy source whose spectral content is largely independent of a modulation signal applied to the energy source.

Another object of the invention is to provide an improved radiant energy diffusion arrangement.

Another object of the invention is to provide a radiant energy source which includes an energy dissipating arrangement capable of absorbing the source output energy during long portions of an operating cycle.

Another object of the invention is to provide a radiant energy source of relatively small size and large energy output capability.

Another object of the invention is to provide a simple and convenient energy modulation arrangement for a radiant energy source.

These and other objects of the invention are achieved by a radiant energy source apparatus which includes incandescent transducer means for converting electrical energy into directed radiant energy, a radiant energy absorbing and dissipating means located in the path of said radiant energy, for absorbing said directed radiant energy, and dissipating said energy by heat transfer, together with externally controllable reflecting means located in the path of said directed radiant energy between said transducer means and said absorbing and dissipating means for selectably intercepting and reflecting a portion of said directed radiant energy prior to arrival at said absorbing and dissipating means, said intercepted reflected energy being diverted external of said radiant energy source apparatus by said reflecting means.

DETAILED DESCRIPTION

Figure 1:
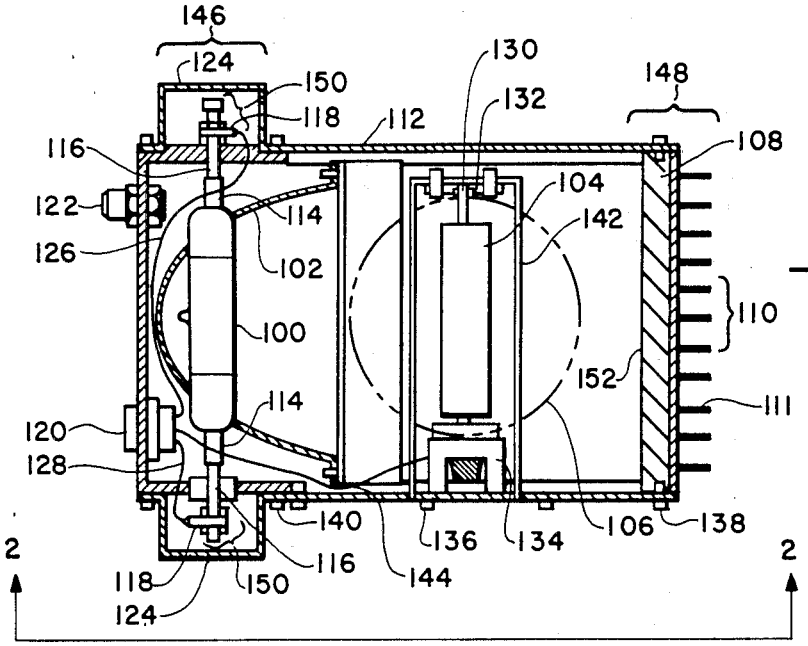
FIG. 1 is a cut-away top view of an optical energy source made in accordance with the invention.
Figure 2:
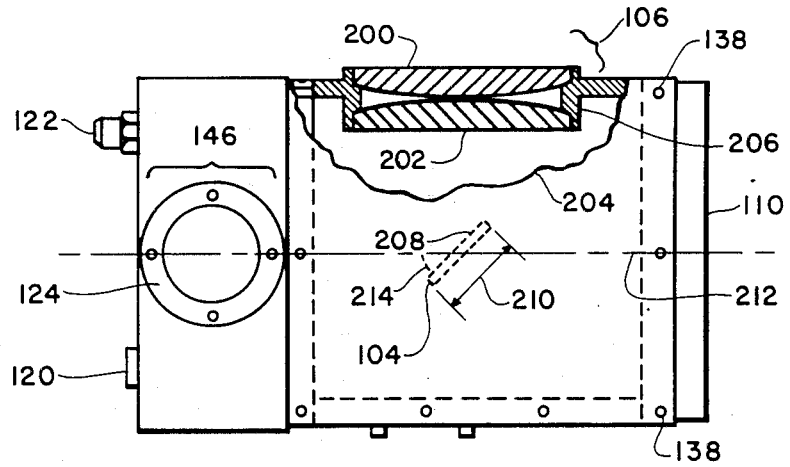
FIG. 2 is a partially cut-away side view of the FIG. 1 energy source.

FIG. 1 and FIG. 2 of the drawings show two views of a modulated optical energy source capable of providing an infrared and visible signature simulation target for a missile acquisition and tracking sensor system. The FIG. 1 source includes a housing 112, a transducer lamp for supplying infrared energy 100, a lamp reflector 102 which is in the form of an ellipsoid, a movably mounted shutter/mirror 104, and a radiant energy absorbing and dissipating assembly 148.

The lamp 100 and reflector 102 in FIG. 1 are part of an energy transducer arrangement or lamp assembly which is indicated generally at 146 and is capable of converting electrical energy into radiant energy having both visible and infrared spectrum components. Commonly, the lamp 100 in the assembly 146 can be operated at energy output levels between 500 and 1000 watts. In addition to the lamp 100 and reflector 102, the FIG. 1 apparatus also includes a lamp mounting and electrical terminal structure 150, and electrical leads 126 and 128, which connect the lamp mounting and terminal structure 150 with an electrical connector 120 that is attached to the housing 112. The lamp assembly 146 also includes a pair of covers 124 for the mounting and electrical terminal structure 150.

The lamp mounting and electrical terminal structure 150 further include a pair of lamp connection electrodes 118 which are preferably of the spring-loaded electrical connection type, and a pair of electrically insulated bushings 116 which serve as a path for a conductor of electrical energy between the electrodes 118 and the lamp housing ends shown at 114.

Also shown in FIG. 1 is a mounting frame 142 for the shutter mirror 104, a rotary solenoid 134 for changing the angular position of the shutter mirror 104, a mirror spindle 130 and a mirror spindle bearing 132, both of which are attached to the mounting frame 142. The lead 144 in FIG. 1 connects a rotary solenoid 134 with the electrical connector 120, while the fasteners such as are shown at 136, 138 and 140 hold the respective parts of the FIG. 1 apparatus in fixed locations; these fasteners may be machine screws, self-tapping screws, rivets or similar devices as are known in the metal fabrication art.

The energy absorbing and dissipating assembly 148 in FIG. 1 includes a radiant energy absorbing member 108 and a finned energy dissipating member 110 that is capable of dissipating heat energy by the radiation and convection mechanisms known in the heat transfer art. The fins 111 of the dissipating member 110 are preferably arranged to be vertically oriented when the FIGS. 1 and 2 energy source is mounted in an equipment in order to achieve the greatest heat transfer. The surface 152 of the dissipating assembly 148 is preferably fabricated from an aluminum honeycomb material of the Hexcel® type which is manufactured by the Hexcel company of Dublin, Calif.

Also shown in FIG. 1 is a pressure connector 122 by which the space within the housing 112 can be evacuated and pressurized with a desirable fluid such as dry nitrogen gas. Pressurizing assumes of course, that the connector 120, the fasteners 136–140, and the other internal to external conduit paths in the FIG. 1 and FIG. 2 apparatus are of a gas-tight nature and that adequate sealing is present around the other openings in the housing 112. At 106 in FIG. 1 there is shown a lens assembly capable of receiving the radiant energy originating in the lamp 100 and reflected by the shutter mirror 104 for transmitting outside of the housing 112. The lens retaining member 206 in the assembly 106 is also gas-tight in nature.

Additional details of the FIG. 1 apparatus are shown in FIG. 2 of the drawings, wherein parts that appear in FIG. 1 are identified with the same number as was used in the FIG. 1 description. In particular in the FIG. 2 drawing, the lens assembly 106 is shown to include a pair of lenses 200 and 202 mounted in the retaining member 206, these details are shown in FIG. 2 by way of the cut-away housing portion indicated at 204. The shutter mirror 104 from FIG. 1 is also shown in FIG. 2 in dotted form, and the reflecting face of the mirror is indicated at 208.

During operation of the FIG. 1 and FIG. 2 apparatus, radiant energy originating on the front side of the filament in the lamp 100 reaches the reflecting face 208 of the shutter mirror 104 and is thence reflected into the lens assembly 106 and transmitted outside the housing 112. In related fashion, radiant energy originating on the back side or left-most FIG. 1 side of the lamp filament is reflected by the curved surface of the reflector 102 and also reaches the reflecting face 208 of the mirror 104. The radiant energy originating on the front and rear sides of the filament of the lamp 100 may be considered to be collimated in nature, that is, of parallel non-diverging rays even though strictly speaking a part of the frontal surface energy and the energy reflected from imperfections in the reflector 102 are each somewhat divergent in nature.

As shown in FIG. 2, the lateral extent of the shutter mirror 104 which is indicated at 210 is sufficiently small as to not intercept all of the radiant energy emanating from the lamp 100, the remainder of this lamp energy is allowed to impinge on the surface 152 of the radiant energy absorbing member 108, where a temperature rise is induced and heat conduction through the radiant energy absorbing member 108 into the finned energy dissipating member 110 occurs. Actually, the shutter mirror 104 can be made large enough to intercept all of the radiant energy emanating from the lamp 100 in its maximum intercept position; it is not necessary to the invention that part of this energy reach the surface 152 in this maximum intercept position of the shutter mirror 104.

By way of the rotary solenoid 134, the amount of energy intercepted by the mirror face 208 and reflected outside the housing 112 is alterable from a maximum value in the position represented in FIG. 2 down to substantially zero. In the FIG. 2 represented position the surface 208 is oriented at an angle 214 of approximately 45° with respect to the axis 212 which extends between the lamp and mirror centers. Rotational movement of the surface 208 by the solenoid 134 therefore provides a means of modulating the radiant energy passing through the lens assembly 106. This modulation is preferably arranged to be a binary or off-on type of modulation in the present invention; analog or amplitude modulation could of course, be arranged in the FIG. 1 and 2 apparatus by providing a solenoid 134 that is capable of linear operation. A linear solenoid could, for example, be fashioned in the manner of the voice coil and extended linear magnetic field employed in loudspeakers in the audio art. When the mirror surface 208 is located in the alternate of the binary modulation rotational positions, i.e., when the angle 214 has a value of near zero degrees, and the shutter mirror is therefore in the minimum intercept position, substantially no energy is reflected into the lens assembly 106 and all of the radiant energy from the lamp 100 is transferred to the surface 152 for dissipation in the finned energy dissipating member 110.

The lamp 100 in FIG. 1 is preferably of the quartz-halogen cycle variety such as the G.E. type DXW 1-kilowatt tungsten lamp of 3200° K. color temperature manufactured by General Electric Company at Cleveland, Ohio. Other lamps or other forms of electrical-to-infrared energy transducers could be employed with the invention. For example, a quartz envelope lamp, even when fabricated using the desired water-free quartz has somewhat less than perfect infrared transmitting capability for use in the invention. Possible alternate materials may be desirable in fabricating a lamp envelope include calcium fluoride and sapphire, each of which has improved far infrared spectral transmission capability in comparison with quartz; such improved spectral transmission is of course, provided at increased lamp envelope expense. Such increased expense may, however, be acceptable in some uses of the invention. Other possible lamp and energy transducer arrangements in FIGS. 1 and 2 include a gas discharge device such as a Mercury Vapor or sodium lamp (with of course, due consideration for the radiant energy spectrum afforded) and incandescent heated structures such as an electrical resistance coil or a chemical reaction heated structure (e.g., a flame heated target).

The infrared transmission capability of the lenses 200 and 202 in FIG. 2 also needs to extend into the far infrared region; preferably the illustrated combination of two lenses should transmit in the range of 90 percent of the incident energy in the 4.2 to 4.4 micron spectral region. For this capability, lenses composed of calcium fluoride or Sapphire, $TiO_2$, $M_2O_2$, CsI, NaCl, KCl, KBr, KI; or antireflection coated Si or Ge; etc. may be used. Handbooks commonly used in the infrared art have entire chapters devoted to refractory materials that transmit energy in this waveband. In similar fashion, the material employed in fabricating the reflectors 102 and 104 in the FIG. 1 and 2 apparatus also needs to provide efficient energy reflection in the selected operating spectral region, such as the infrared region. A preferred arrangement for these reflectors is described below.

With regard to the rationale for employing the mirror 104 as a modulator for the radiant energy output of the FIG. 1 and 2 apparatus in lieu of a more conventional and energy conserving modulation arrangement such as interrupting the electrical energy supply to the lamp, it should be realized that the radiant energy output of the preferred halogen cycle incandescent filament lamp and other energy transducers such as a gas discharge lamp requires a finite period of lamp burning in which to become stabilized—both as to spectrum and amplitude. Particularly with respect to the far infrared region output of lamps of this type, the initial lamp spectrum is of diminished infrared energy content to a degree that maintaining of the lamp-on condition is desirable in the FIG. 1 and FIG. 2 apparatus. The use of constant lamp operation together with energy absorbing and dissipating using the assembly 148 is preferable therefore to removing electrical energy excitation of the lamp in an infrared source or other spectrum critical sources which can be based on the FIG. 1 and FIG. 2 apparatus.

Although most of the radiant energy emanating from the lamp 100 impinges on the surface 152 and the surface 208 of the mirror 104, it is found desirable to employ blackened surfaces on the interior of the housing 112 in order to provide absorption of stray or random reflected energy which does not impinge on one of these preferred surfaces.

Suitable arrangements for mounting the preferred quartz-halogen lamp in the FIG. 1 and FIG. 2 apparatus are, of course, known in the art and are shown in representative form in FIGS. 1 and 2 of the drawings. Generally, the components used in mounting lamps of this type are fabricated from metal, ceramic, and high-temperature plastic materials in response to the necessary operation of such lamps at elevated temperatures. In similar fashion, high-temperature insulation such as ceramic beads, asbestos, teflon, or other materials known in the electrical art is preferably used on the electrical leads 126 and 128 by which the lamp 100 receives excitation. As a means of protecting the lamp 100 from physical shock while also maintaining tight electrode electrical connections, the lamp mounting arrangement usually involves both a spring loaded support and a spring-loaded connector apparatus; details of these arrangements are omitted from FIG. 1 and FIG. 2 for drawing clarity. A pair of covering cups 124 are shown in FIG. 1 and FIG. 2 for physically shielding the lamp and connector elements from external abuse and for completing the gas-tight seal of the housing 112.

The relatively small size of the FIGS. 1 and 2 apparatus lends to the use of such energy sources in an aircraft. A preferred embodiment of the FIG. 1 and FIG. 2 apparatus measures about $20.3 \times 15.3 \times 11.7$ cm and weighs approximately 5 pounds. Clearly even the smallest of possible target simulation aircraft is capable of containing a plurality of such energy sources. For aircraft use the filament of the lamp 100 may be operated directly from a 28-volt DC electrical source or from an alternating current source such as 400-cycle AC using a transformer. Other arrangements for the lamp filament including tradeoffs between lamp voltage and current in order to achieve filament rigidity and the use of regulated energy sources are known in the lamp and electrical arts.

In an airacraft environment for the FIG. 1 and FIG. 2 apparatus large changes in operating environment temperature and humidity are to be expected, along with the possibility of moisture condensation within the housing 112 and the resulting corrosion and other undesirable chemical changes of elements in the FIG. 1 and 2 apparatus. These difficulties can be largely circumvented by providing a sealed dry gas atmosphere within the housing 112. Nitrogen or other inert gases such as the fluorinated hydrocarbon refrigerant gases can be used for this atmosphere. A pressure fitting 122 is shown in FIG. 1 for use in achieving a desirable atmosphere within the housing 112. A nitrogen atmosphere within the housing 112 has been found desirable with regard to the absence of significant energy absorption in the far infrared spectral region by nitrogen gas.

Considering now the optical characteristics of the FIG. 1 and FIG. 2 apparatus; for use as an infrared invisible signature simulation source, it is desirable for the energy output beam to provide an angular coverage of 16°×60° or ±8°×±30°, as measured from a central axis with the ±30° beamspread being oriented in a forward and aft direction when the FIG. 1 and FIG. 2 apparatus is mounted in an aircraft. Within this 16°×60° angular coverage an intensity variation less than 30% over the beam extent is desirable with less than 10% fluctuation over any 1/10 degree angle within the 60 degree angular coverage.

To achieve these quantitative values it is found desirable to locate the lamp 100 at one focus of the ellipsoid reflector 102 with the lamp axis orthogonal to the ellipsoidal major axis as shown in FIGS. 1 and 2 and with the second focus of the ellipsoidal reflector 102 being coincident with the focal point of the pair of projection lenses in the assembly 106. In this arrangement of the FIG. 1 and 2 apparatus the reflecting surface 208 of the shutter mirror 104 can conveniently have size of 1×2½inches and should provide an apparent source size of filament image of at least ⅝ inch×2 ¼inches.

To achieve the desired values of image size and uniformity it is found desirable to employ diffusing surfaces at the reflector 102 and at the reflecting surface 208 of the shutter mirror 104. One arrangement of diffusing surface suitable for use in these locations is shown in the cut-away segment 300 in FIG. 3 of the drawings. Within this segment 300 are shown three typical surface regions 302, 304, and 306 which include texture marks of the type indicated at 308 and 310. The lines 312 and 314 in FIG. 3 indicate that the three typical surface regions 302, 304 and 306 extend over the entire portion of the surface segment 300; the abbreviated FIG. 3 showing is accomplished for drawing convenience.

Figure 3:
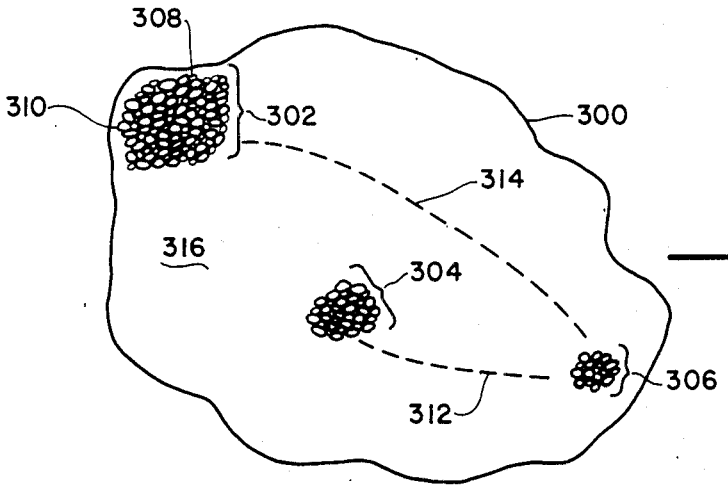
FIG. 3 is an example portion of a diffusing reflector surface usable in the source of FIG. 1 and FIG. 2.

The FIG. 3 arrangement can be achieved by selecting the reflector material indicated at 316 to be metallic in nature, preferably aluminum or brass metals of hardness range 50 to 70, and forming the diffusing marks indicated at 308 and 310 by a metal working technique. The marks 308–310 can, for example, be achieved by a peening process wherein the metallic reflector material is impacted repeatedly by small moving pellets which have been propelled by compressed air, centrifugal force, the acceleratin of gravity or other accelerating arrangements. Other surface roughening techniques such as sand blasting, chemical etching, knurling or wrinkling could be used for the reflecting surfaces of FIGS. 1 and 2, however, the indentations of peening as described above have been found most satisfactory in achieving the desired quantitative measures of radiant energy dispersion.

The lenses 200 and 202 in the lens assembly 106 are preferably 3 inch diameter plano-convex lenses of 4 inch focal length and are fabricated from one of the materials indicated above such as calcium fluoride, which is transparent to far spectrum infrared radiation. The compound pair of 4-inch focal length lenses provides a lens pair focal length of 2 inches; the lenses 200 and 202 are therefore located 2 inches from the second focus of the ellipsoidal reflector 102 in order that the lens focus point and the ellipsoidal reflector second focus point be coincident.

The FIG. 1 and 2 apparatus as described above is capable of delivering about 40% of the 4.2 to 4.4 micron spectral region energy produced in the lamp source 100 to the beam emanating from the lens assembly 106. Assuming the use of a 1000 watt quartz-halogen lamp, a radiant intensity of 1.2 watts per steradian in the 4.2 to 4.4 micron band can be achieved for each radiant energy source module of the FIG. 1 and FIG. 2 type. Each module also provides a total TBA radiation intensity of 26.4 watts per steradian. The FIG. 1 and FIG. 2 apparatus as described above is also capable of providing a corner-to-center intensity ratio of 0.7 to 1 or better.

Variations in the FIG. 1 and FIG. 2 apparatus such as the incorporation of optical filtering elements to better exclude radiation in undesired frequency bands could, of course, be incorporated into the FIG. 1 and FIG. 2 apparatus. In similar fashion, different types of lamps such as the gaseous discharge lamp described above might also be employed in the FIG. 1 and 2 apparatus. Additionally, reflectors and lenses having selected spectral bandpasses could be used in the FIG. 1 and FIG. 2 apparatus in order to enhance the output from an optical energy source in one spectral region, such as the visible spectrum region. Slight improvements in the visible spectrum or higher frequency output regions from the FIG. 1 and 2 apparatus could also be achieved by changing the operating color temperature of an employed incandescent filament lamp transducer as is known in the lamp art.

Another variation of the FIG. 1 and 2 apparatus as mentioned previously could be achieved by using the rotary solenoid 134 or a related type of magnetic apparatus as an analog or continuously variable displacement member in order that the position of the shutter mirror 104 be variable in response to an amplitude varying modulation signal and in contrast with the binary or on-off nature of the modulation described above. The mass involved in the solenoid and shutter mirror strucures together with the quantities of energy available to move these masses in a modulation arrangement will determine the frequency response capability of the modulated radiant energy source. The modulation frequency response capability of a system of this type is of course inherently limited to low frequencies in comparison to the modulation rates achievable in electronic circuits and laser optical devices and in other technologies. A modulated light source of the type shown in FIG. 1 and FIG. 2 may, however, be useful in manual signalling and other limited frequency applications.

While the apparatus and method herein described constitute a preferred embodiment of the invention, it is to be understood that the invention is not limited to this precise form of apparatus or method, and that changes may be made therein without departing from the scope of the invention, which is defined in the appended claims.

We claim:

1. Infrared radiant energy source apparatus comprising:

incandescent transducer means for converting electrical energy into collimated infrared spectrum radiant energy;

radiant energy absorbing means located in the radiation path of said collimated radiant energy for absorbing said energy and incurring thereby increased operating temperature;

thermal energy dissipating means conductively connected with said energy absorbing means for dissipating absorbed radiant energy to ambient surroundings external of said source apparatus; and externally controllable reflecting means located in the path of said collimated radiant energy between said transducer means and said absorbing means for selectably enabling energy transfer along said radiation path in one condition thereof and for directionally diverting a portion of said energy prior to arrival at said absorbing means in another condition thereof, said diverted energy being directed external of said source apparatus by said reflecting means.

2. The energy source apparatus of claim 1 further including optical lens means located in the directionally diverted path of said reflecting means for controlling the degree of convergence of said externally directed energy.

3. The energy source apparatus of claim 1 wherein said controllable reflecting means includes a mirror member movable between energy diverting and non-diverting positions.

4. The energy source apparatus of claim 3 further including electrically operable solenoid means connected with said movable mirror member for rotating said mirror between said energy diverting and non-diverting positions.

5. The energy source apparatus of claim 4 wherein said solenoid means includes a rotary solenoid.

6. The energy source apparatus of claim 1 wherein said incandescent transducer means includes an incandescent filament electric lamp.

7. The energy source apparatus of claim 6 wherein said incandescent transducer means includes a curved reflector member.

8. The energy source apparatus of claim 7 wherein said incandescent filament lamp is a halogen cycle tungsten filament lamp.

9. The energy source apparatus of claim 1 wherein said dissipating to ambient surroundings includes radiation and convection heat transfer mechanisms.

10. The energy source apparatus of claim 9 wherein said dissipating means further includes finned heat transfer means for performing said radiation and convection heat transfer.

11. The energy source apparatus of claim 10 wherein said incandescent transducer means comprises a source of radiant energy in the far infrared spectral range.

12. The energy source apparatus of claim 11 wherein said incandescent transducer means comprises a source of radiant energy in the 4.2 to 4.4 micron spectral range.

13. The energy source apparatus of claim 1 wherein said incandescent transducer means includes an incandescent lamp having a quartz envelope.

14. The energy source apparatus of claim 1 wherein said transducer means includes a lamp envelope fabricated from infrared energy transmitting calcium fluoride.

15. The energy source apparatus of claim 1 wherein said transducer means includes a lamp envelope fabricated from infrared energy transmitting sapphire.

16. The energy source apparatus of claim 1 wherein said incandescent transducer means and said controllable reflecting means each include diffusing mirror members.

17. The energy source apparatus of claim 16 wherein said diffusing mirror members include a peened metal surface capable of spreading a reflected image uniformly over a larger area than a smooth surface mirror member.

18. The energy source apparatus of claim 17 wherein one of said metallic mirror members is comprised of aluminum.

19. The energy source apparatus of claim 18 wherein one of said metallic mirror members is comprised of brass.

20. The energy source apparatus of claim 1 wherein said controllable reflecting means includes a glass mirror member.

21. The energy source apparatus of claim 1 wherein said incandescent transducer means has an electrical energy input rate in excess of five hundred watts.

22. Mechanically switched infrared radiant optical energy supply apparatus comprising:

an electrical-to-optical energy transducer source of infrared radiant energy having forward and backward facing sides and a central axis normal thereto;

a first optical energy reflector member of ellipsoidal shape located along said axis adjacent said energy transducer source backward facing side;

an optical energy dissipating member located along said axis adjacent said energy transducer source forward facing side and capable of dissipating the radiant infrared energy received from said energy transducer source forward facing side and said energy transducer source backward facing side and first reflector member as thermal energy; and a planar second optical energy reflector member located along said axis intermediate said electrical-to-optical energy transducer source and said first optical energy reflector member and capable of diverting optical energy from said energy transducer source forward facing side and said first reflector member to a path angularly disposed of said axis in a first movement attained position thereof and of enabling transmission from said transducer source and said reflector member to said dissipating member in a second movement attained position thereof.

23. The apparatus of claim 22 wherein said planar second reflector member is a peened surface metallic mirror.

24. The apparatus of claim 22 wherein said first optical energy reflector member includes a mechanical peening marked reflecting surface.

25. The apparatus of claim 22 wherein said electrical-to-optical energy transducer source includes radiation in the far infrared radiant energy spectrum.

26. A method for generating low frequency pulsed infrared optical energy comprising the steps of:

transducing electrical energy into a collimated field of infrared energy;

directing said collimated field of infrared energy along a first optical path to an infrared to thermal energy dissipating transducer;

diverting a portion of said collimated field energy onto an energy output second path external of said thermal energy transducer in response to an electrical signal induced mechanical movement altering of said first optical path;

diffusing the infrared energy within said collimated field prior to said diverting step; and additionally diffusing said infrared energy during said diverting step.

* * * * *